US005212335A

United States Patent [19]

Suzuki

[11] Patent Number: 5,212,335

[45] Date of Patent: May 18, 1993

[54] ELECTRONIC KEYBOARD INSTRUMENT WITH A SIMPLE TONE GENERATION ASSIGNOR

[75] Inventor: Toru Suzuki, Saitama, Japan

[73] Assignee: Kabushiki Kaisha Kawai Gakki Seisakusho, Shizuoka, Japan

[21] Appl. No.: 904,483

[22] Filed: Jun. 25, 1992

[30] Foreign Application Priority Data

Jun. 27, 1991 [JP] Japan ..... 3-183001

[51] Int. Cl.[5] ..... G10H 1/22

[52] U.S. Cl. ..... 84/618; 84/DIG. 2

[58] Field of Search ..... 84/618, DIG. 2; 340/825.5, 825.51

[56] References Cited

U.S. PATENT DOCUMENTS 4,911,052 3/1990 Saito et al. ..... 84/DIG. 2

*Primary Examiner*—Stanley J. Witkowski

[57] ABSTRACT

A tone generation apparatus for an electronic keyboard instrument which stores key information for at least one channel in an assignment memory (33), and sets tone source parameters of a tone generator (19) according to the key information is disclosed. A key ON/OFF register (31) having a bit string corresponding to key numbers stores key ON/OFF information. When a key corresponding to the currently tone-ON key information stored in the assignment memory (33) is released, ON key information in the register (31) is searched by a search block (32) from, e.g., the high pitch side. If another ON key information is detected, the content of the assignment memory (33) is changed to the key information so as to generate a corresponding tone.

3 Claims, 7 Drawing Sheets

ELECTRONIC KEYBOARD INSTRUMENT WITH A SIMPLE TONE GENERATION ASSIGNOR

BACKGROUND OF THE INVENTION

1. Field of the Invention

The present invention relates to a tone generation apparatus for, e.g., an electronic keyboard instrument.

2. Description of the Related Art

In electronic keyboard instruments such as an electronic piano, an electronic organ, and the like, tone source information stored in a PCM waveform memory is read out according to a tone color and key information, and is output as a tone generation signal after its amplitude, envelope, and the like are processed. In order to generate tones corresponding to some simultaneously depressed keys or to generate accompaniment tones, a tone generator has a plurality of simultaneous tone channels.

A channel assignor manages tone channels, and assigns a tone to be generated in response to a key-ON event to an empty channel or a channel having a low priority order.

As a key assign method of the assignor, a first-depression priority method or a last-depression priority method is known. Also, the following method is known. In this method, when there is no empty channel, the envelopes of assigned tone waveforms are compared, and a new key is assigned to a tone channel generating the lowest envelope level, i.e., a channel closer to the end of tone generation (envelope minimum value detection method).

An electronic keyboard instrument, which can select the following sole (monophonic) play mode, is known. In the sole-play mode, only one channel (or two channels) is assigned as a tone generation channel corresponding to a keyboard operation, and other tone channels are assigned to auto-accompaniment tones, and the like. In this sole-play mode, channel assignment processing called a key recovery method is often applied for.

In the key recovery method, tone generation is performed in a monophonic last-depression priority mode, and a key depressed last is assigned to a single tone channel. When a plurality of keys are depressed, tones are sequentially generated in the last-depression priority manner, and at the same time, the key ON order is stored in a table. When a currently tone-ON key is released, if there is another key in key ON state, the last key in the last-depression order in the depression order storage table is assigned to the tone channel to generate a corresponding tone (key recovery processing).

The above-mentioned key recovery processing in the sole-play mode requires complicated processing steps, and also requires a stack area of a memory for storing the key ON order.

FIG. 6 shows an assignor (channel assignment) processing sequence based on the conventional key recovery method, and FIGS. 7A to 7C are views for explaining stack processing of a memory for storing the key ON order.

In step 71, it is checked if a play mode is a poly (polyphonic) play mode or a sole (monophonic) play mode. In the poly-play mode, poly processing is performed in step 72. In the sole-play mode, an ON/OFF event of a key is discriminated in step 73. If an ON event is detected, a tone channel is searched and assigned in step 74, and the key ON order is stored in a stack as key recovery information in step 75. FIG. 7A shows the content of a stack 19*a* at this time. When key ON events occur in the order of C, B, and A, note codes (key codes) A, B, and C are stored in the order of A, B, and C from the lower end of the stack area 19*a*. When a key D is newly depressed at that time, a tone corresponding to a note D is generated, and a note code D is stored in the lower end of the stack area 19*a* (push).

If a key OFF event is detected in step 73, it is checked in step 76 if a key corresponding to the detected OFF event is the same as the key assigned to a currently tone-ON channel. If YES in step 76, OFF information of the key is generated (assign OFF) in step 77. In step 78, the stack area is rewritten (pull), and in step 79, the stacked last key information is assigned to a tone channel (key recovery processing). For example, when note codes C, B, and A are stacked in this order in the stack area, as shown in FIG. 7B, if the key A is released, the note code A is pushed out from the stack area upon tone-OFF processing of the key A, and the note code B is assigned to the tone channel.

If it is determined in step 76 that the OFF key is different from the currently tone-ON channel content, only rewrite processing of key recovery information is performed in step 80. For example, when node codes C, B, and A are stacked in this order, as shown in FIG. 7C, if the key B is released, the note code B is deleted from the stack area, and the key ON order is rewritten to C and A. Tone generation corresponding to the key A is continued.

As described above, the contentional key recovery processing in the sole-play mode requires many program steps, and consumes the stack area for storing the key ON order. Since the CPU of the electronic musical instrument executes real-time processing, an expensive, high-speed microprocessor is required.

When the stack area is saved, the number of pieces of key recovery information to be held is limited. When a large number of keys are simultaneously depressed, it is difficult to perform key recovery processing.

SUMMARY OF THE INVENTION

It is an object of the present invention to simplify a key assign system in a sole-play mode to decrease the number of program steps, so that sufficiently high-speed response characteristics can be obtained by a low-speed processor.

It is another object of the present invention to reduce the load on hardware necessary for processing by executing key recovery processing without storing a key ON order, i.e., without using a stack.

A tone channel assignment apparatus of the present invention comprises an assignment memory 33 for storing key information for at least one channel, and supplying the key information to a tone generator 19, a storage means (key ON/OFF register) 31, having a bit string corresponding to key numbers, for storing key ON/-OFF information in each bit, search means 32 for searching key ON information stored in the storage means in a predetermined pitch order, and assignment control means for, when a key corresponding to tone-ON key information stored in the assignment memory 33 is released, rewriting the content of the assignment memory 33 with another ON key information obtained by the search means 32, and causing the assignment memory to send the key information to the tone generator 19.

The search means 32 searches key ON/OFF bit information stored in the storage means 31 from, e.g., the high-pitch side. Therefore, when a tone-ON key is released, if another ON key is detected, the key can be assigned to the tone channel as a tone generation key in simply a high-pitch priority manner. If the OFF key is not a tone-ON key, a bit corresponding to the key in the storage means 31 is reset to a key OFF state.

DETAILED DESCRIPTION OF THE PREFERRED EMBODIMENT

Figure 1:
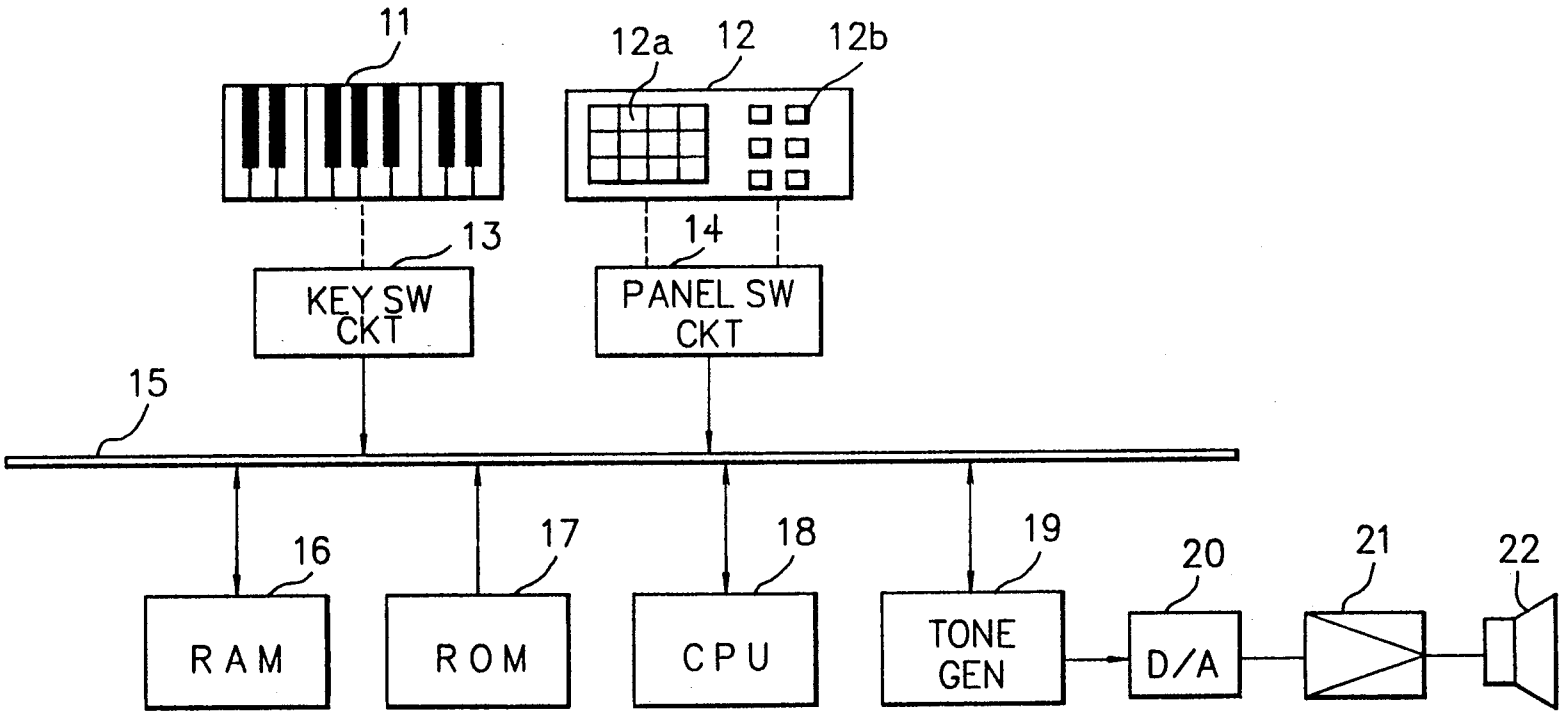
FIG. 1 is a block diagram showing the overall arrangement of an electronic musical instrument according to an embodiment of the present invention.

FIG. 1 is a block diagram showing principal part of an electronic musical instrument according to an embodiment of the present invention. The electronic musical instrument comprises a keyboard 11 and an operation panel 12. The circuit portion of the electronic musical instrument is constituted by a microcomputer consisting of a CPU 18, a ROM 17, and a RAM 16, which are connected to each other through a bus 15.

The CPU 18 supplies note information corresponding to a keyboard operation, and parameter information such as rhythm data, tone color data, and the like corresponding to an operation of a ten-key pad 12*a*, panel switches 12*b*, and the like to a tone generator 19. The tone generator 19 reads out PCM tone source data from the ROM 17 on the basis of these pieces of information, processes the amplitude and envelope of the readout data, and supplies the processed data to a D/A converter 20. A tone signal obtained from the D/A converter 20 is supplied to a loudspeaker 22 through an amplifier 21.

Figure 2:
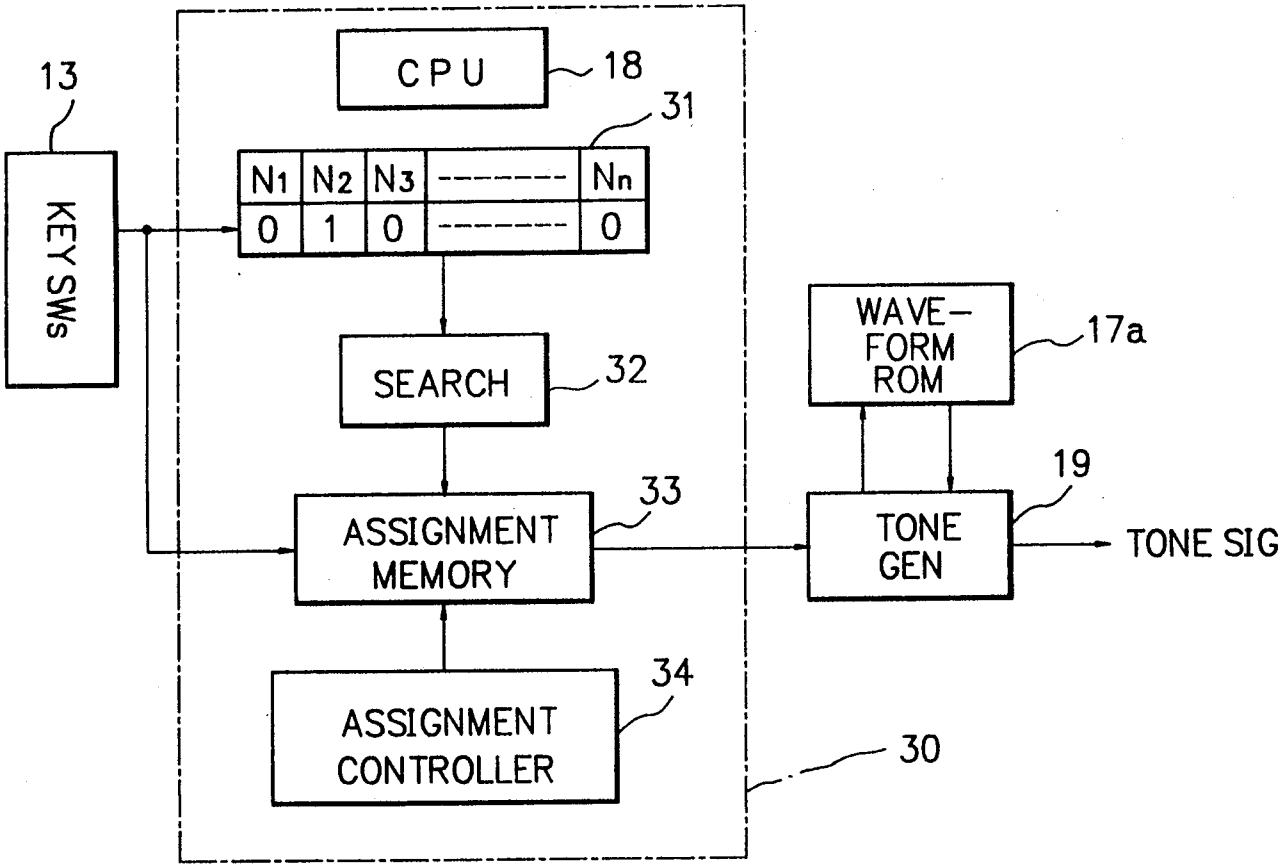
FIG. 2 is a block diagram showing principal constituting members as the characteristic feature of the present invention.

FIG. 2 is a functional block diagram of a channel assignor 30 in the electronic musical instrument shown in FIG. 1. Note that the functions of the assignor are realized by the CPU 18, a program written in the ROM 17, and the RAM 16 shown in FIG. 1. The assignor 30 corresponds to a sole-play mode, and a conventional assignor is used in a poly-play mode.

The assignor 30 is mainly constituted by an assignment memory 33, for one channel, for supplying assigned key information to the tone generator 19, a note ON/OFF register 31 for storing a key ON bit "1" and key OFF bit "0" in correspondence with all the keys N1 to Nn, a search means 32 for searching the content of the register 31 in a predetermined order, and an assignment controller 34.

Note that the note ON/OFF register 31 is arranged for the CPU 18 to recognize ON events on the keyboard 11, and is also used in an assignor in a conventional electronic musical instrument.

Figure 3:
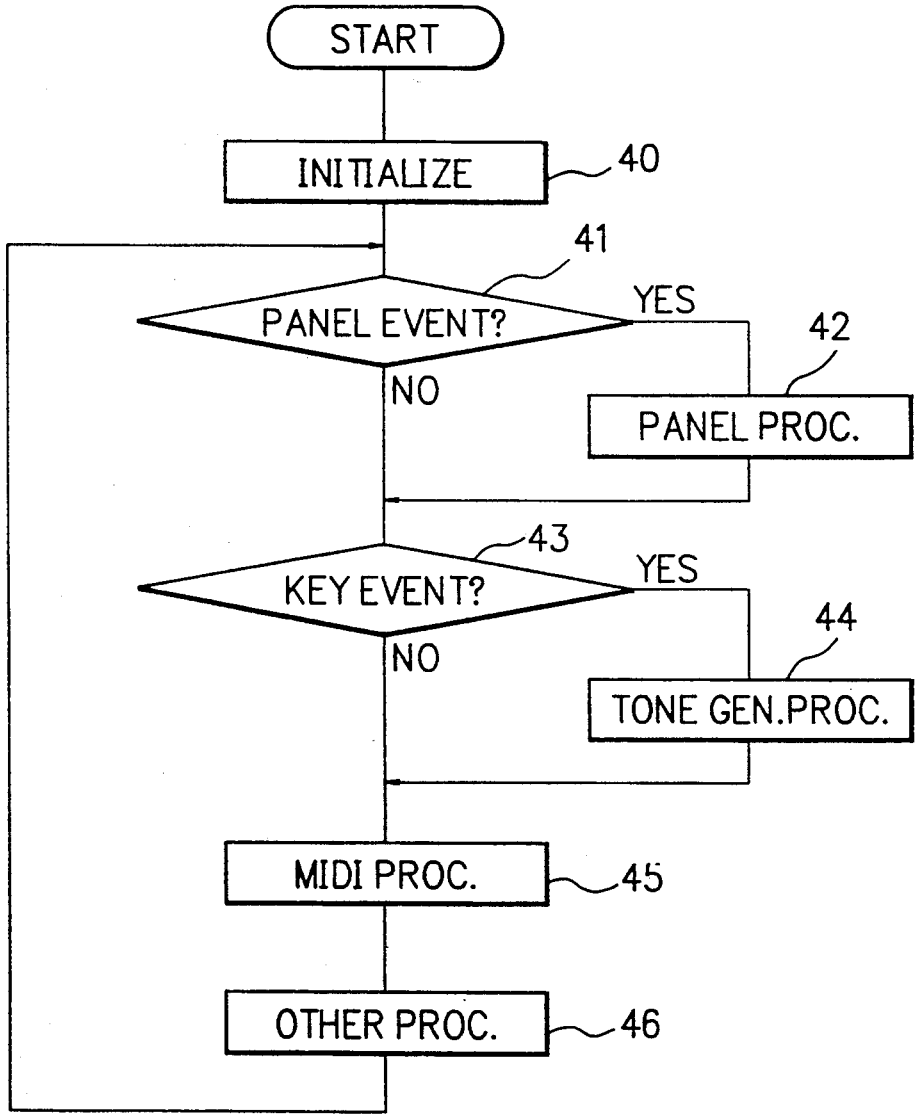
FIG. 3 is a flow chart showing main routine processing by a CPU.
Figure 4:
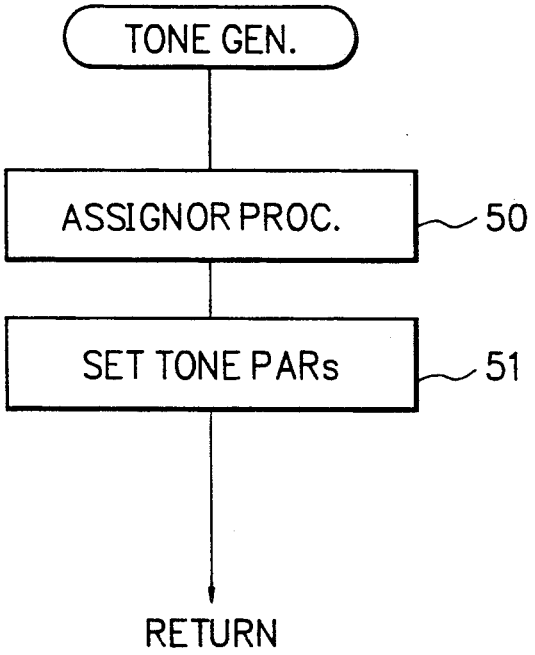
FIG. 4 is a flow chart showing tone generation processing.
Figure 5:
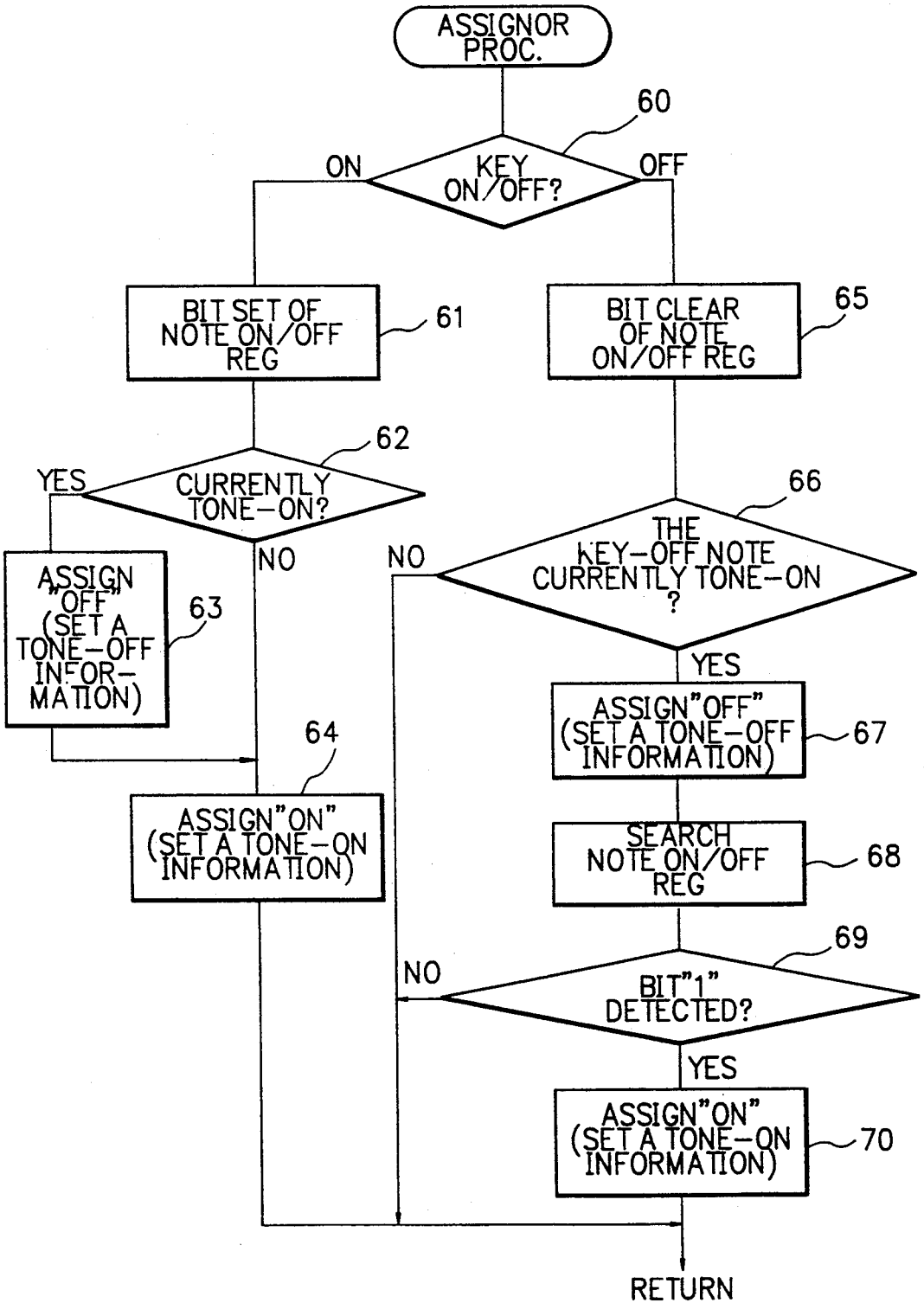
FIG. 5 is a flow chart showing assignor processing.
Figure 6:
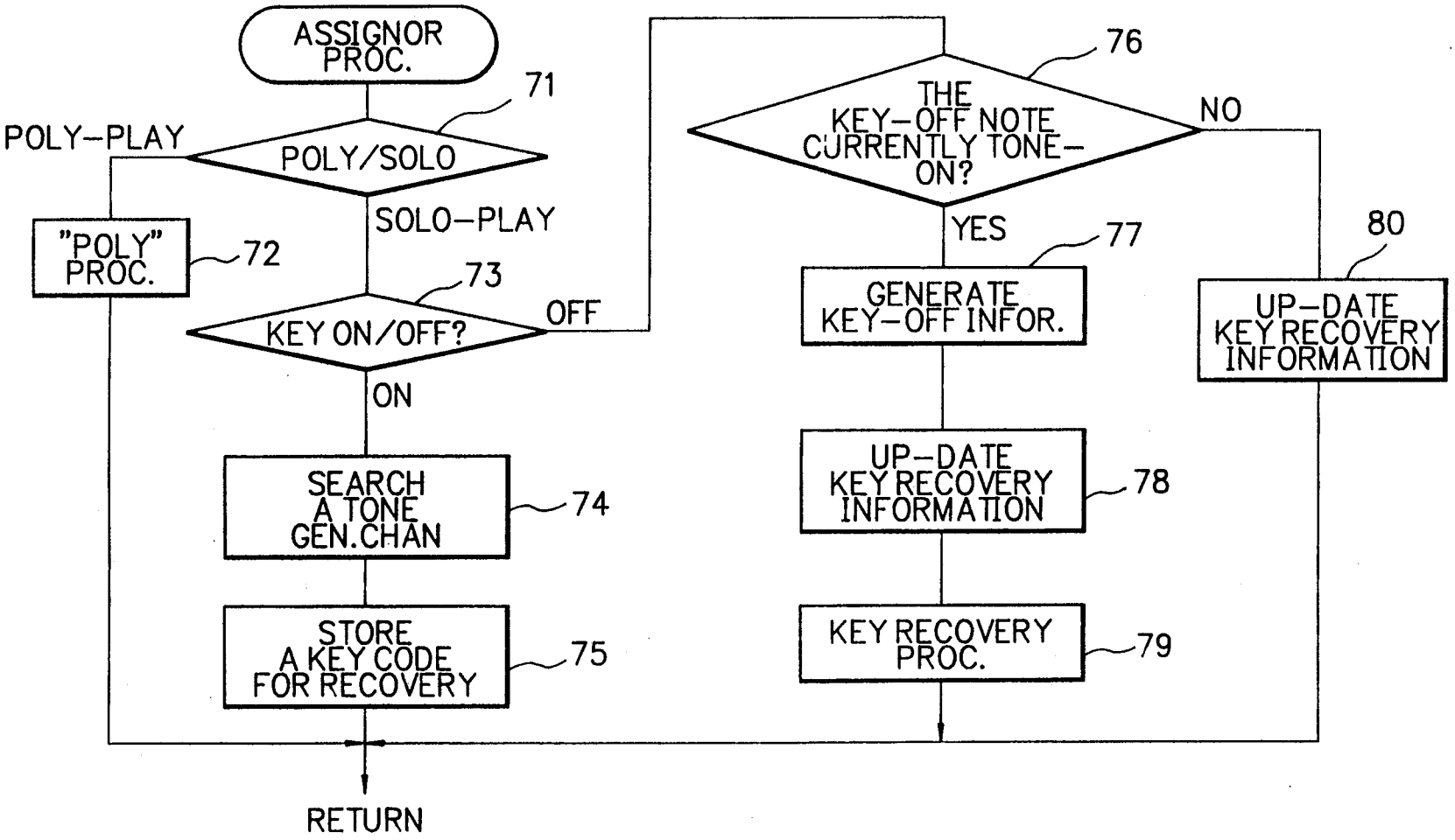
FIG. 6 PRIOR ART
FIG. 6 is a flow chart showing conventional assignor processing.
Figure 7A:
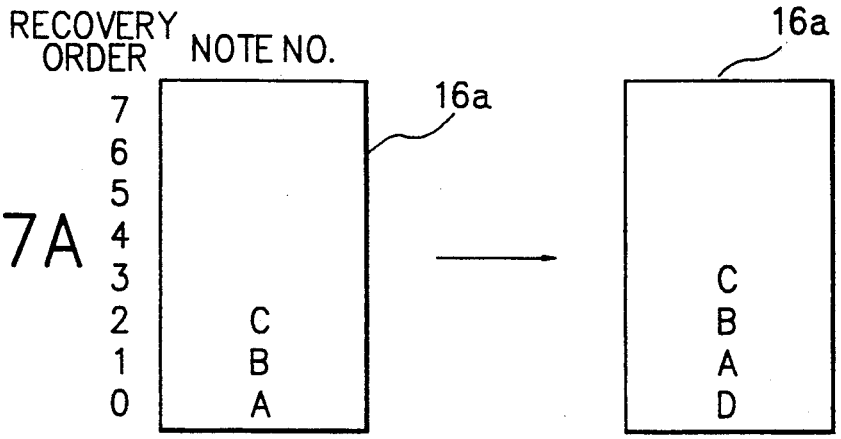
PRIOR ART FIG. 7A
FIGS. 7A to 7C are explanatory views of a stack area used in the conventional assignor processing.
Figure 7B:
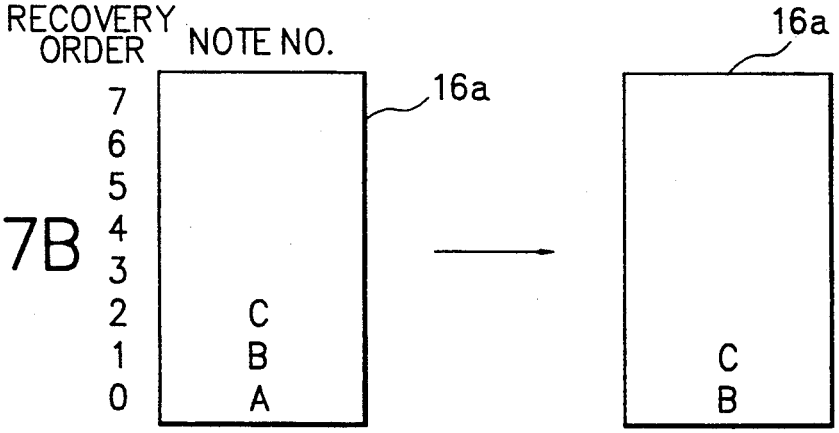
Figure 7C:
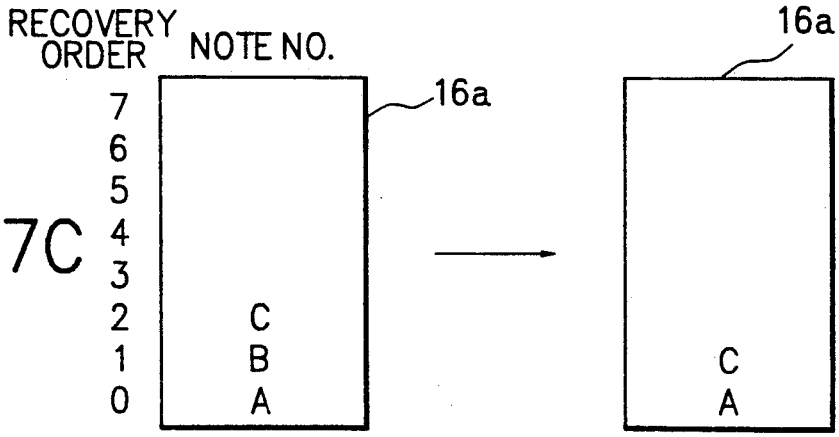

FIGS. 3 to 5 show a tone generation processing sequence by the CPU 18. FIG. 3 shows the main routine. In the initialization processing in step 40, the system is initialized, and in step 41, the panel switches are scanned. If an ON switch is detected, panel processing is performed in step 42. In step 43, key switches are scanned. If an ON switch is detected, tone generation processing of the corresponding key is performed in step 44. In step 45, MIDI Processing for an auto-play mode is performed. In step 46, other processing operations are performed. This main routine is circulated at a given cycle.

FIG. 4 shows the tone generation processing in step 44 in FIG. 3. In step 50, assignor (channel assign) processing is performed. In step 51, tone generation parameters are transferred from the assignor 30 to the tone generator 19 to set the tone generation parameters, thus generating a corresponding tone. The tone generator 19 reads out a PCM signal of a designated tone color from a waveform memory 17*a* at a designated pitch on the basis of the set tone generation parameters, modulates the envelope and amplitude of the waveform, and outputs the modulated waveform as a tone signal.

FIG. 5 shows the processing steps of the assignor 30. In step 60, it is checked if a key event is an ON or OFF event. If an ON event is detected, the bit of the corresponding key number Ni in the note ON/OFF register 31 in FIG. 2 is set in step 61. In step 62, it is checked if the corresponding channel is currently in a tone-ON state. If YES in step 62, tone-OFF information is generated by the assignor 30 (assign OFF processing) (step 63). If NO in step 62 or if the assign OFF processing is performed, the flow advances to step 64 to perform channel assignment corresponding to the ON key. More specifically, tone-ON information to be transferred to the tone generator 19 is set in the assignment memory 33. These processing operations in steps 63 and 64 are performed by the assignment controller 34.

Therefore, the assignor processing upon a key ON event is the same as that in the conventional assignor, and tones are generated in the key ON order. In this case, no stack for storing the key ON order is used.

If a key OFF event is detected in step 60, the bit of the corresponding key number Ni in the note ON/OFF register 31 is cleared in step 65. In step 66, it is checked if a key-OFF note (key number) is the same as that of the currently tone-ON key. This checking operation is performed by the assignment controller 34 on the basis of the content of the assignment memory 33 shown in FIG. 2.

If it is determined in step 66 that the key-OFF note is not the same as that of the currently tone-ON key, the flow returns to the main routine. That is, the currently tone-ON key is maintained. However, if the key-OFF note is the same as that of the currently tone-ON key, the flow advances to step 67, and assign OFF processing (for setting tone-OFF information) for the corresponding key is performed, thereby stopping tone generation.

The flow advances to step 68, and the bits in the note ON/OFF register 31 are searched from, e.g., the high-pitch side. If a bit "1" is detected in step 69, assign processing (for setting tone-ON information) for a key corresponding to the detected bit is performed in step 70. More specifically, if another ON key remains when tone generation of one key is stopped, the key is assigned to the tone generation channel in a high-pitch priority manner (key recovery processing). If no bit "1"

is detected in step 69, the flow returns to the main routine without performing key recovery processing.

As described above, when keys are depressed in the order of, e.g., key numbers $F_3$, $D_3$, and $C_3$ without being released, tones are generated in the order of $F_3$, $D_3$, and $C_3$. When the $C_3$ key is released, the key $F_3$ having a higher pitch of the remaining $F_3$ and $D_3$ keys is assigned to the tone generation channel. That is, the key recovery processing can be performed without using a stack area for storing the key ON order. In this case, the key recovery processing can be performed regardless of the number of ON keys. In the conventional system, the key recovery processing is performed in the key ON order, and the number of keys to be recovered is limited by the number of segments of the stack. Therefore, according to the system of the present invention, an unique play effect unlike in the prior art can be expected.

In the processing in step 68 in FIG. 5, the note ON/-OFF register 31 is searched in the high-pitch order, but may be searched in a low-pitch order. Alternatively, if a search order is determined in a fixed random pitch order, and if a search operation is performed in this order, the same effect can be expected.

In the above embodiment, the assignment memory 33 in the assignor 30 is prepared for one channel. However, assignment memories may be prepared for two channels in correspondence with the right and left hands.

According to the present invention, as described above, when a tone-ON key is released, a storage means (key ON/OFF register 31) having bits corresponding to key numbers is searched from, e.g., the high-pitch side. If another ON key remains, a tone-ON content is changed based on key information obtained by the search operation.

Therefore, according to the present invention, when one key is released, since tone-ON change (key recovery) processing to another ON key is performed based on a simple search algorithm in a high- or low-pitch order in place of conventional complicated processing that stores a key ON order, the number of program steps can be decreased, and high-speed response characteristics can be obtained even when an inexpensive, low-speed microprocessor is used.

Since no stack area of a memory for storing a key ON order is used unlike in the prior art, the arrangement is simple, and the number of required hardware members can be decreased.

What is claimed is:

1. A tone generation apparatus for an electronic keyboard instrument, comprising:

an assignment memory for storing key information for at least one channel, and transferring the key information to a tone generator;

storage means, having a bit string corresponding to key numbers, for storing key ON/OFF information of a key in the corresponding bit;

search means for searching key ON information stored in said storage means in a predetermined pitch order; and assignment control means for, when a key corresponding to tone-ON key information stored in said assignment memory is released, changing a content of said assignment memory with another ON key information obtained by said search means, and causing said assignment memory to supply the changed key information to said tone generator.

2. An apparatus according to claim 1, wherein the predetermined pitch order in said search means is a high-pitch order.

3. An apparatus according to claim 1, wherein the predetermined pitch order in said search means is a low-pitch order.

* * * * *